US009854914B2

(12) United States Patent
Yoo

(10) Patent No.: US 9,854,914 B2
(45) Date of Patent: Jan. 2, 2018

(54) FOLDING CHAIR

(71) Applicant: ING LEISURE CO., LTD., Pyeongtaek-si, Gyeonggi-do (KR)

(72) Inventor: Ji Soo Yoo, Bucheon-si (KR)

(73) Assignee: ING LEISURE CO., LTD., Pyeongtaek-si (KR)

( * ) Notice: Subject to any disclaimer, the term of this patent is extended or adjusted under 35 U.S.C. 154(b) by 0 days.

(21) Appl. No.: 15/306,462

(22) PCT Filed: Jun. 2, 2016

(86) PCT No.: PCT/KR2016/005865
§ 371 (c)(1),
(2) Date: Oct. 24, 2016

(87) PCT Pub. No.: WO2016/195400
PCT Pub. Date: Dec. 8, 2016

(65) Prior Publication Data

US 2017/0181548 A1 Jun. 29, 2017

(30) Foreign Application Priority Data

Jun. 2, 2015 (KR) ..... 10-2015-0078052

(51) Int. Cl.
*A47C 4/44* (2006.01)
*A47C 3/00* (2006.01)
*A47C 4/30* (2006.01)

(52) U.S. Cl.
CPC . *A47C 4/44* (2013.01); *A47C 4/30* (2013.01)

(58) Field of Classification Search
CPC ..... A47C 4/44; A47C 4/30
USPC ..... 297/16.1, 16.2, 45
See application file for complete search history.

(56) References Cited

U.S. PATENT DOCUMENTS

| | | | | |
|---|---|---|---|---|
| 3,927,733 | A | 12/1975 | Wurn et al. | |
| 8,979,184 | B2 * | 3/2015 | Stafford | A47C 3/18 297/16.2 |
| 2002/0117878 | A1 * | 8/2002 | Fox | A47C 3/18 297/16.2 |
| 2009/0174233 | A1 * | 7/2009 | Hoffman | A47C 4/286 297/16.2 |

(Continued)

FOREIGN PATENT DOCUMENTS

| | | |
|---|---|---|
| EP | 0 139 306 A1 | 5/1985 |
| JP | S58-44007 A | 3/1983 |

(Continued)

*Primary Examiner* — Milton Nelson, Jr.
(74) *Attorney, Agent, or Firm* — Maschoff Brennan

(57) ABSTRACT

A folding chair enables a user to easily change directions in a sitting state. The user's posture can be supported to prevent sagging in response to the weight of the sitting user. The folding chair includes a lower block having a first stopper connected with an end of each of the legs of the chair. The first stopper parts limit the other ends of the legs from rotating in the lower central direction. An upper block has a second stopper that horizontally rotates based on an axial connection to the lower block and is connected to an end of each of a plurality of support parts. The second stoppers limit the other ends of the support parts from rotating in the lower central direction. A seat connects the other ends of the support parts. The legs and the support parts can be folded or unfolded in the same directions.

8 Claims, 10 Drawing Sheets

(56) References Cited

U.S. PATENT DOCUMENTS

2014/0306493 A1* 10/2014 Obolewicz ..... A47C 4/42
297/16.2

FOREIGN PATENT DOCUMENTS

| | | | |
|---|---|---|---|
| KR | 20-0147235 | Y1 | 6/1999 |
| KR | 20-0283572 | Y1 | 7/2002 |
| KR | 10-1397958 | B1 | 5/2014 |
| KR | 20-0475702 | Y1 | 12/2014 |

* cited by examiner

FOLDING CHAIR

TECHNICAL FIELD

The present invention relates to a folding chair wherein a user can easily change directions in a sitting state, and a user's posture can be supported stable in such a way to prevent the sagging in a predetermined direction in response to the weight of the sitting user being focused in the direction.

BACKGROUND ART

The folding chair which, in general, is used outdoors, is formed of a metallic frame, and a sitting member made of a synthetic resin sheet material engaged to the frame.

The frame is configured to be easily folded, and when not in use, the whole parts of such a folding chair are folded, thus reducing a storing space and facilitating a carriage thereof.

The configuration of the aforementioned folding chair is described in the Korean utility model registration number 20-0283572 and the Korean utility model registration number 20-0475702.

In the above conventional folding chair, the user cannot change directions in a sitting state. If it needs to change the direction where the user is seeing, the user should lift up the whole parts of the folding chair, change the direction of the folding chair and then sit in the folding chair.

In order to improve the aforementioned problems, a folding chair as illustrated in FIG. 1 is developed, wherein a lower block, an upper block, legs, supports and sitting members can be folded into a minimum volume, and when in use, such components can be easily assembled.

According to the aforementioned conventional folding chair as illustrated in FIG. 1, the rotations of the supports employed to support the sitting member can be limited in the upward direction about the connected portions to a hinge; however the rotations in the downward direction is not limited. As indicated by the arrow in FIG. 1, the portions of the supports configured to function in response to the focusing of the user's weight may be easily leaned in the downward direction, which may cause conveniences when in use.

DISCLOSURE OF INVENTION

Technical Problem

Accordingly, the present invention is made in an effort to resolve the aforementioned problems. It is an object of the present invention to provide a folding chair wherein a user can easily change directions in a sitting state, and the sagging or tiling of the folding chair in a predetermined direction can be prevented in response to the focusing of a user's weight in the aforementioned direction or the forward direction in a sitting state, and when it needs to store the folding chair, the supports connecting the upper block can be folded in the central and downward direction together with the legs of the lower block, thus reducing the whole volume of the folding chair.

Technical Solution

To achieve the above objects, there is provided a folding chair, which may include, but is not limited to, a lower block equipped with a first stopper part which is connected via a first hinge pin with an end of each of a plurality legs along a circumference thereof, wherein the first stopper part is configured to limit the other end of each of the legs to rotate in the lower central direction and between first angles which have been previously set; an upper block equipped with a second stopper part which is configured to horizontally rotate based on an axial connection to the lower block and is connected via a second hinge pin to an end of each of a plurality of support parts along a circumference thereof, wherein the second stopper part is configured to limit the other end of each of the support parts to rotate in the lower central direction and between second angles which have been previously set; and a seat member which is installed connecting the other end of each of the support parts which receive the supports of the upper side rotation angles from the second stopper part, wherein the legs and the support parts are configured to be folded or unfolded in the same directions.

Moreover, the lower block includes a through hole, and a support tubular body a lower end of which is inserted in the through hole, and the upper block includes an engaging groove into which an upper end of the support tubular body is inserted, and a rotary shaft which is inserted in the support tubular body.

In addition, the second stopper part is configured in such a way that a portion covering the top of an end of the support part extends and protrudes outward from the center of the upper block while forming the second angle, and the second hinge pin is installed at a side portion of the outer side of the second stopper, and the support part is configured in such a way that a longitudinal hole having a predetermined length in the longitudinal direction of the support part while passing through the second hinge pin is formed at a side portion of one side thereof, and the support part is configured in such a way that the other end thereof is rotatable within a second angle range from the lower central direction when an end of one side of the longitudinal hole is hung over the second hinge pin, and a sliding occurs in the central direction of the upper block by receiving the guides from the second stopper part and the second hinge pin in the second angle state, and the rotation of the other end thereof is prevented in a state where the second hinge pin has slid to position at a portion which is out of an end of one side of the longitudinal hole.

Furthermore, the upper block includes an insertion groove into which an end of one side of the support part is inserted at a second angle in response to the sliding of the support part.

In addition, there is further provided an elastic member an end of which is fixed at an end in the depth direction of the insertion groove, and the other end of which is fixed at an end of the support part, wherein the elastic member is configured to provide an elastic force for the support part arranged at a second angle to be inserted in the insertion groove.

Moreover, there is further provided an elastic member an end of which is fixed at the second hinge pin, and the other end of which is fixed at the other end of the support part, wherein the elastic member is configured to provide an elastic force for the support part arranged at a second angle to be inserted into the insertion groove.

In addition, the second stopper part includes a guide hole having a predetermined length in the longitudinal direction, and a portion configured to cover the top of the support part extends and protrudes outward from the center of the upper block at the second angle, and the second hinge pin is installed at the support part in such a way to be slide-engaged to the guide hole, and the support part is configured in such a way that when an end of one side of the guide hole is hung over the second hinge pin, the other end thereof is rotatable within a range of the second angle from the lower central direction, and a sliding is available in the central direction of the upper block by receiving the guides from the second stopper part and the second hinge pin in a state of the second angle, and the rotation of the other end thereof can be prevented in a slid state for the second hinge pin to position out of an end of one side of the guide hole.

Furthermore, the upper block further comprises an insertion groove into which an end portion of one side of the support part is inserted at a second angle in response to the sliding of the support part.

Moreover, there is further provided an elastic member an end of which is fixed at an end in the depth direction of the insertion groove, and the other end of which is fixed at the second hinge pin, wherein the elastic member is configured to provide an elastic force for the support part arranged at a second angle to be inserted in the insertion groove.

Advantageous Effects of the Invention

According to the folding chair of the present invention, a user is able to easily change directions while the user sits on a seat member, and if a user's weight is leaned in a predetermine direction including the forward direction in a sitting state, the sagging can be prevented through an operation wherein the support disposed in the aforementioned direction is inserted in a second stopper part of an upper block, a second hinge pin and an insertion groove, by which the user can maintain a stable posture, and when it needs to store the folding chair, the support connected with the upper block is withdrawn outward of a second angle and is folded in the downward direction of the center together with the legs of the lower block.

BEST MODES FOR CARRYING OUT THE INVENTION

Figure 1:
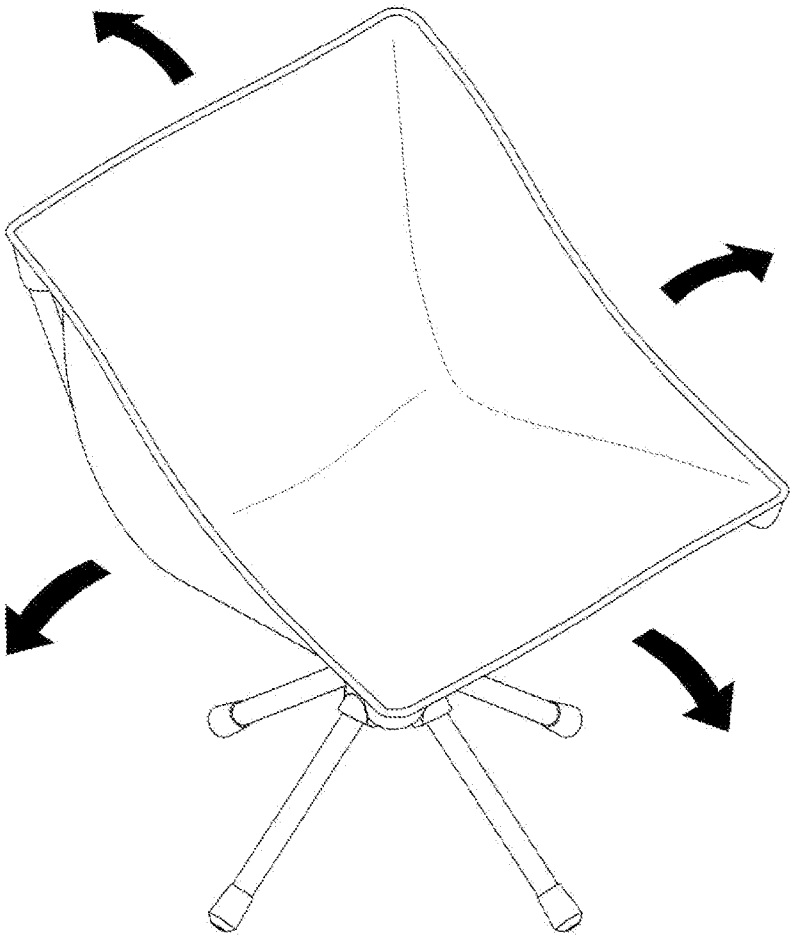
FIG. 1 is an engaged perspective view illustrating a conventional folding chair.

According to the best mode of the present invention, there is provided a folding chair, which may include, but is not limited to, a lower block equipped with a first stopper part which is connected via a first hinge pin with an end of each of a plurality legs along a circumference thereof, wherein the first stopper part is configured to limit the other end of each of the legs to rotate in the lower central direction and between first angles which have been previously set; an upper block equipped with a second stopper part which is configured to horizontally rotate based on an axial connection to the lower block and is connected via a second hinge pin to an end of each of a plurality of support parts along a circumference thereof, wherein the second stopper is configured to limit the other end of each of the support parts to rotate in the lower central direction and between second angles which have been previously set; and a seat member which is installed connecting the other end of each of the support parts which receive the supports of the upper side rotation angles from the second stopper part, wherein the legs and the support parts are configured to be folded or unfolded in the same directions.

MODES FOR CARRYING OUT THE INVENTION

The terms or words used throughout the specification claims of the present invention should not be interpreted based on the typical or dictionary definition, but should be interpreted as representing the meaning and concept which correspond to the technical concepts of the present invention based on the principle where "an inventor is able to appropriately define the concepts of a corresponding term to describe his invention in the best way".

Moreover, the embodiments and components illustrated in the drawings of the present invention are intended to describe only the preferred embodiments of the present invention, not representing all the technical concepts of the present invention, so that various equivalents and modified examples which could substitute such things can belong to the claims of the present invention.

Moreover, in the course of the descriptions of the present invention, the expression of one end or one side may represent the central direction of the lower block and the upper block or a portion disposed in the direction thereof, and the expression of the other end or the other side may represent the outward direction from the center between the lower block and the upper block or a portion disposed in the direction thereof.

While the present invention is being described, the expression of the lower side and the upper side may be defined based on the use state of the folding chair.

Referring to FIGS. 2 to 8, the configuration of the folding chair according to one specific example of the present invention will be described.

The folding chair according to the present invention may include, but is not limited thereto, a lower block 10 equipped with a first stopper part 11 which is connected via a first hinge pin (h1) to an end of each of a plurality of legs 12 along a circumference and is configured to limit the other end of each of the legs 12 to rotate in the lower central direction and between the previously set first angles; an upper block 20 equipped with a second stopper part 21 which horizontally rotates via a shaft connection the lower block 10 and is connected via a second hinge pin (h2) to an end of each of a plurality of support parts 22 along a circumference and is configured to limit the other end of each of the support parts 22 to rotate in the lower central direction and between the previously set second angles; and a seat member 30 which is installed connecting the other end of each of the support parts 22. The legs 12 and the support parts 22 are configured to be folded and unfolded in the same directions.

Figure 4:
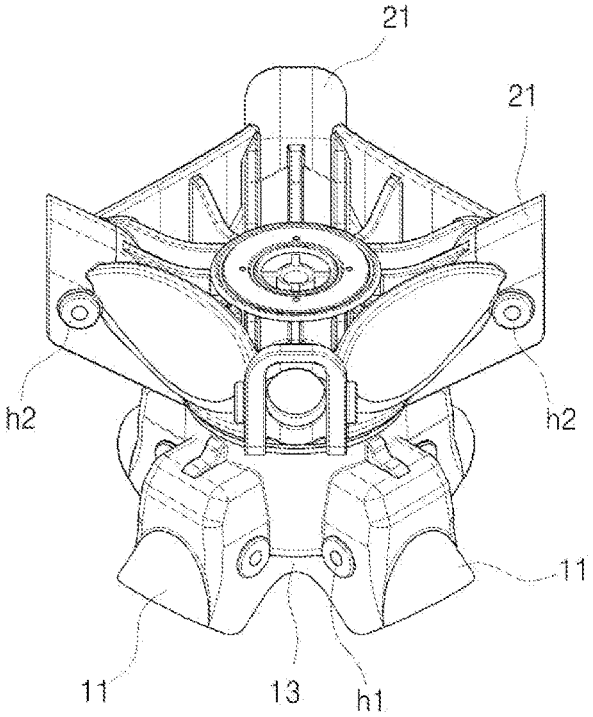
FIG. 4 is a perspective view illustrating an engaged state of an upper block and a lower block of a folding chair according to the present invention.
Figure 5:
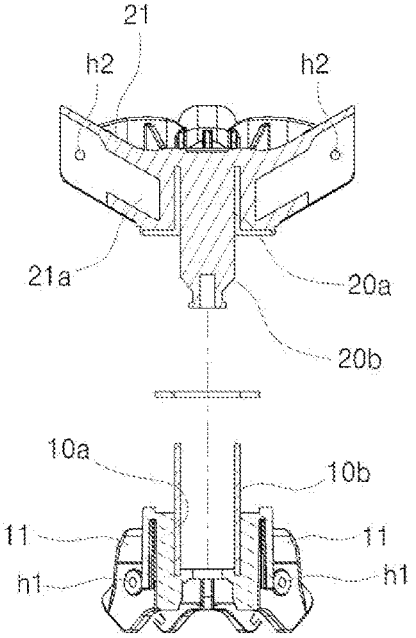
FIG. 5 is a side cross sectional view illustrating a state where an upper block and a lower block of a folding chair are engaged according to the present invention.
Figure 6:
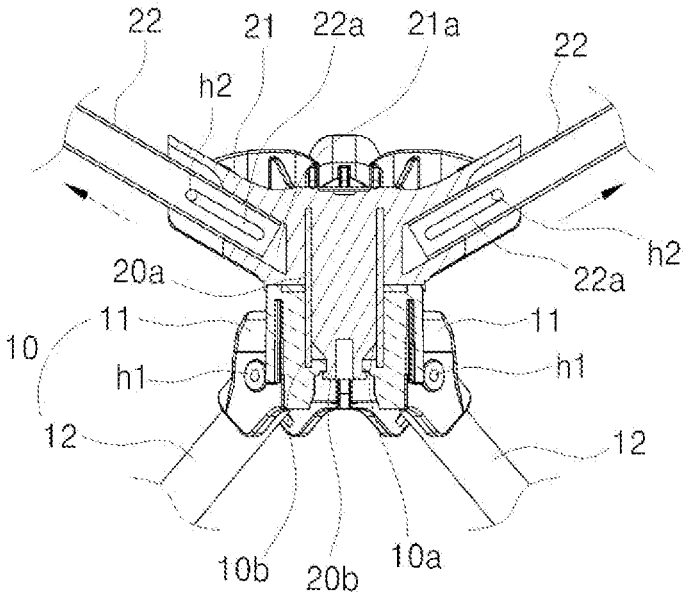
FIG. 6 is a side cross sectional view illustrating an engaged state of an upper block and a lower block of a folding chair according to the present invention.
Figure 7:
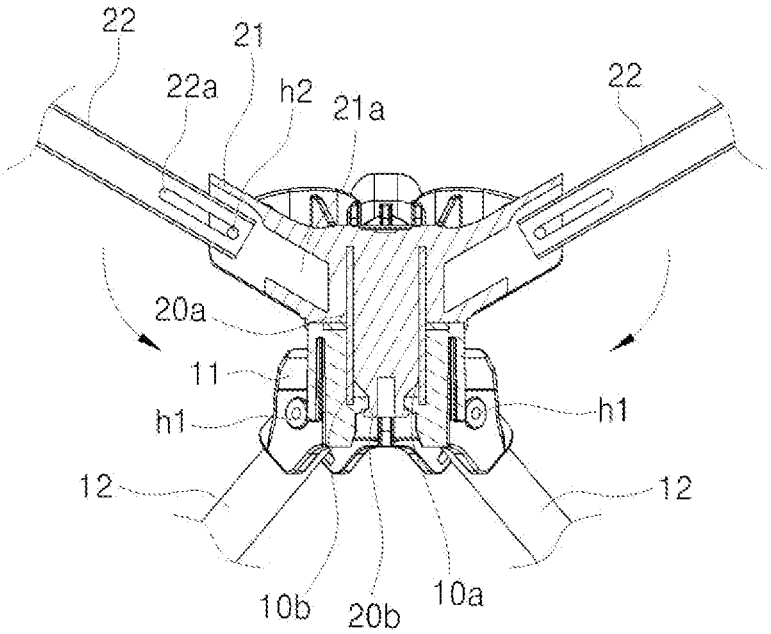
FIG. 7 is a side cross sectional view illustrating an engaged state of an upper block and a support part of a folding chair according to the present invention.
Figure 8:
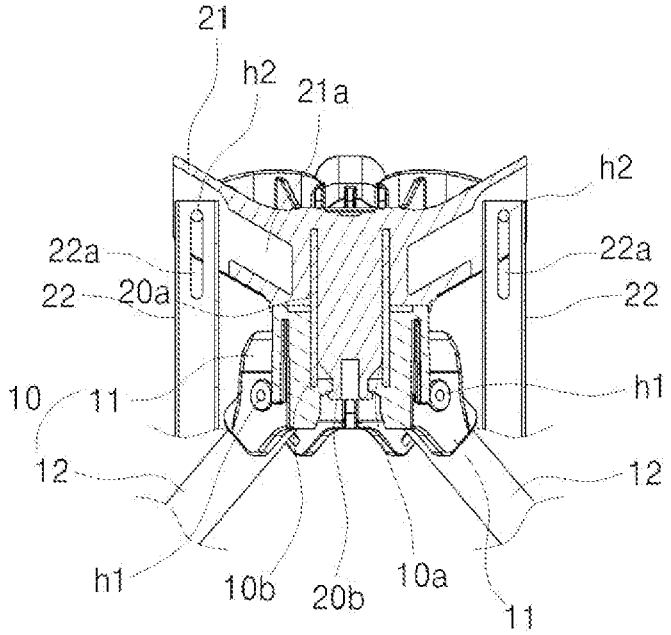
FIG. 8 is a side cross sectional view illustrating another engaged state of an upper block and a support part of a folding chair according to the present invention.

As illustrated in FIGS. 3 to 8, the lower block 10 may be configured in such a way that a plurality of the legs 12 are connected via the first hinge pin (h1) along a circumference thereof, and as illustrated in FIGS. 6 to 8, are configured to rotate upward and downward about the connected portion to the first hinge pin (h1).

Moreover, the upper frame 20 may be configured in such a way that the support part 22 is connected to rotate upward and downward via the second hinge pin (h2) along a circumference thereof, and as illustrated in FIGS. 4 and 5, it may be connected rotatable about the shaft connected to the upper side of the lower block 10.

The lower block 10 may be formed in a block type made of a high strength synthetic resin material, wherein a through hole 10*a* passing through the upper and lower surfaces may be formed in the center thereof, and a support tubular body 10*b* extending upward and downward is engaged to the through hole 10*a*.

Moreover, the support tubular body 10*b* may be formed of a single circular pipe made of a high strength metallic material, wherein the lower end thereof is fixedly embedded inside of the through hole 10*a*, and the other end thereof extends upward of the lower block 11.

It is preferred that the legs 12 are made of a high strength metallic tubular body.

In addition, as described earlier, the lower block 10 may be equipped with a support tubular body 10*b* installed in such a way that the lower end thereof is inserted in the through hole 10*a*, and the upper block 20 may include an engaging groove 20*a* into which the top of the support tubular body 10*b* is inserted, and a rotary shaft 20*b* which is inserted in the support tubular body 10*b*.

It is preferred that the upper block 20 is made in a block type made of a high strength synthetic resin material, and it is preferred that the engaging groove 20*a* is formed at a lower side surface of the upper block 20, and the rotary shaft 20*b* may be formed extending from the inside of the engaging groove 20*a*.

Furthermore, it is preferred that the first stopper part 11 of the lower block 10 and the second stopper part 21 of the upper block 20 are spaced apart from each other at an angle of 90°.

A washer engaged to an outer portion of the support tubular body 11*b* may be further provided between the lower block 10 and the upper block 20.

As illustrated in FIGS. 6 to 8, the present invention may be configured in such a way that a plurality of the support parts 22 are engaged rotatable via the second hinge pin (h2) to the second stopper part 21 of the upper frame 20, wherein the user is able to fold or unfold the support parts 22, as illustrated in FIGS. 6 to 8, about the connected portion to the second hinge pin (h2).

Figure 3:
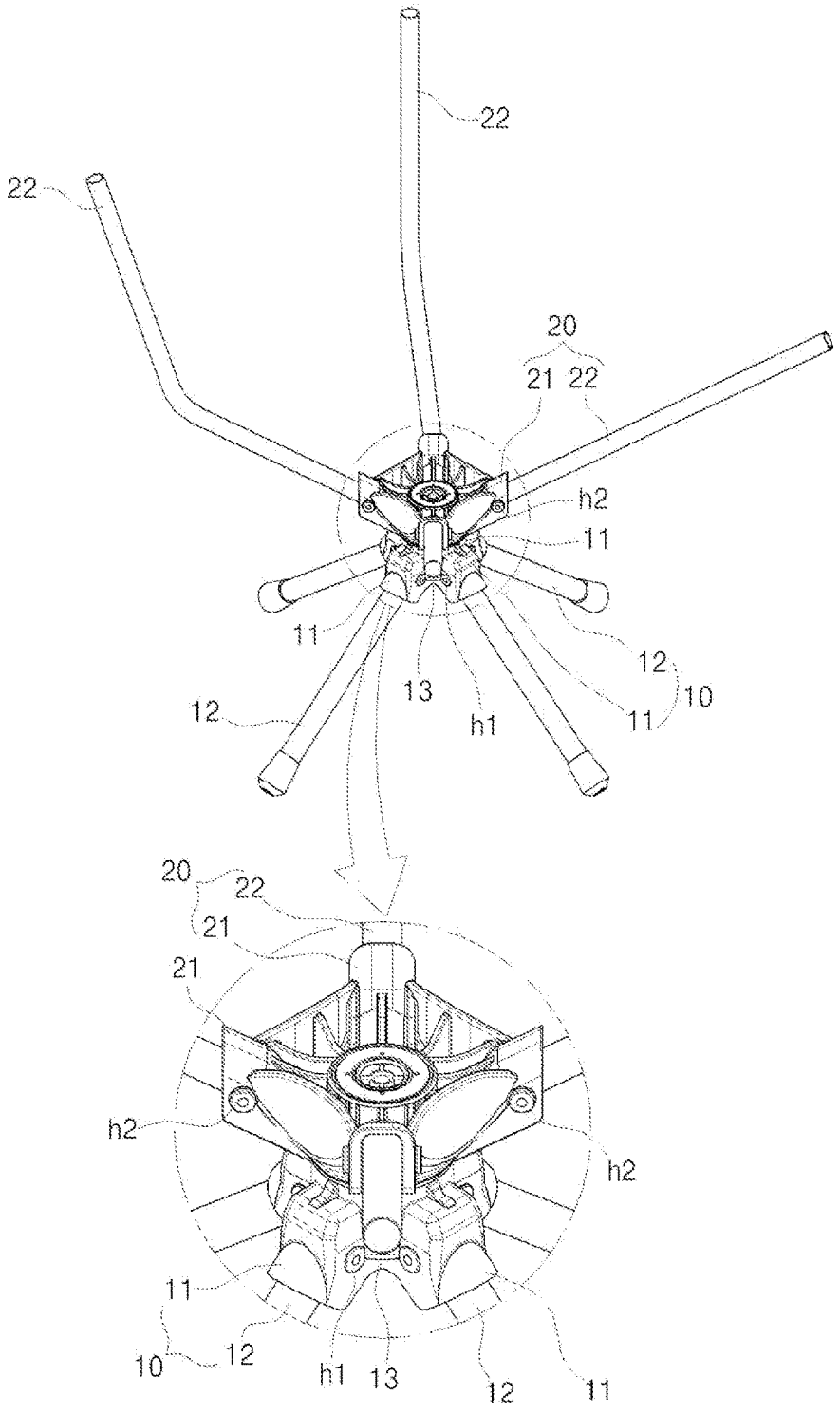
FIG. 3 is a perspective view illustrating an engaged state of an upper block and a lower block of a folding chair according to the present invention.

For example, as illustrated in FIGS. 3 and 6, in a state where the support parts 22 connected about the second hinge pin (h2) are unfolded, the support parts 22 may maintain the closely contacted state with the second stopper part 21 of the upper frame 20 as seen in FIG. 6. In this state, even if a user sits on the seat member 30 connected to the support parts 22, it is possible to prevent a plurality of the support parts 22 connected to the seat member 30 from sagging or leaning in a predetermined direction.

Moreover, a plurality of the legs 12 which are connected to the first stopper part 11 of the lower block 10 based on the configuration of the first hinge pin (h1) are connected to limit the rotations thereof within a previously set first angle. The previously set first angle may be determined based on the values to adjust the rotation direction and angle of the legs 12 connected via the first stopper part 11 and the first hinge pin (h1) while the user is forming the first stopper part 11.

For example, if the angle where the legs 12 connected via the first hinge pin (h1) to the first stopper part 11 are unfolded, is set for the sake of the rotations at an angle within 30~70° C. about the connected portion to the first stopped part 11, the user is able to implement such a configuration in such a way to variously change the configuration and shape of the first stopper part 11 and the legs 12 connected thereto.

The support parts 22 connected via the second hinge pin (h2) to the second stopper part 21 are connected for the rotations thereof to be limited within a previously set second angle. As illustrated in FIG. 3, the second angle may represent the angle of the support parts 22 which are unfolded about the second hinge pin (h2), and the configuration of the second stopper part 21 may be determined so that the angle where the support parts 22 are unfolded, can be limited.

If the user wants to limit the unfolding angles of the legs 12 and the support parts 22 within a predetermined range, it is obvious that the configurations of the first stopper part 11 and the second stopper part 22 can be variously changed based on the user's selection.

Moreover, the second stopper part 21 may be configured extending and protruding outward from the center of the upper block 20 while a portion covering the tops of the support parts 22 defines a second angle, and the second hinge pin (h2) may be installed at an outer side portion of the second stopper part 21, and the support part 22 may be equipped with a longitudinal hole 22*a* at one side portion thereof, wherein the second hinge pin (h2) passes through the longitudinal hole 22*a*, and the longitudinal hole 22*a* has a predetermined length in the longitudinal direction of the support parts 22.

As illustrated in FIGS. 6 to 9, this configuration is referred to a configuration to facilitate the engagement and disengagement of the second stopper part 21 and the support parts 22. The support parts 22 engaged via the second hinge pin (h2) to the second stopper part 21 can be unfolded or folded through an engaged configuration of the second hinge pin (h2) and the longitudinal hole 22*a*.

Moreover, in the aforementioned configuration, an insertion groove 21*a* may be further formed at the upper block 20, wherein an end of one side of the support part 22 is inserted at a second angle in response to the sliding of the support parts 22. As illustrated in FIG. 6, if the support parts 22 are engaged to the second stopper part 21, the engaged portions of the support parts 22 may slide in the insertion groove 21*a*, by which the stopper part 21 and the support parts 22 can be more strongly engaged, thus securing a stably fixed state of the support parts 22.

With the aid of the aforementioned configuration, the seat member 30 can be easily installed over the top of the upper block 20, and if the user sits on the seat member 30, it can be possible to easily prevent the support parts 22 connected to the seat member 30 from sagging or leaning in a predetermined direction.

Figure 9:
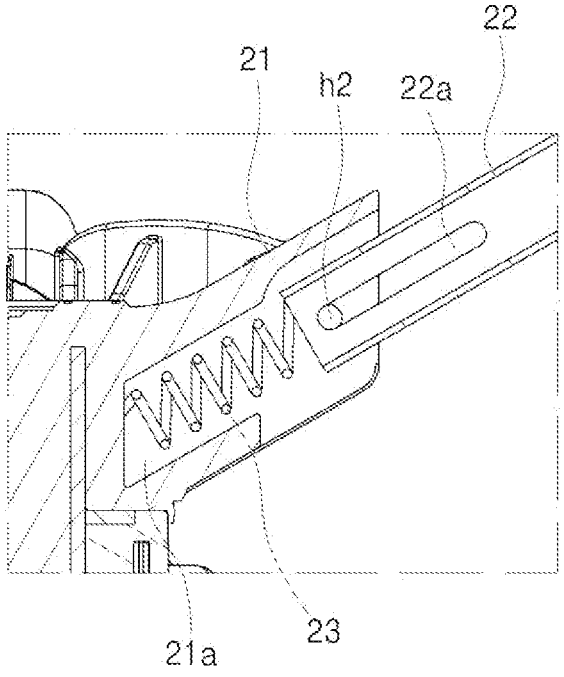
FIG. 9 is a side cross sectional view illustrating a state wherein an upper block and a support part of a folding chair are connected via an elastic member according to the present invention.

As illustrated in FIG. 9, in the present invention, the support part 22 may further include an elastic member 23 configured to provide an elastic force for the sake of an insertion in the insertion groove 21*a*, wherein the support member 22 is configured in such a way that one end thereof is fixed at an end in the depth direction of the insertion groove 21*a*, and the other end thereof is fixed at an end of the support part 22, by which the support part 22 can be arranged at a second angle.

As illustrated in FIG. 9, the configuration of the elastic member 20 may contribute to the easier and strong engagement of the support parts 22 in the direction of the insertion groove 21*a*.

The elastic member 23 may be formed of any of various elastic members 23, for example, a spring, an elastic string, an elastic wire, etc. which may be selected according to a user's determination, as long as an elastic force can be transferred to the support parts 22 engaged to the insertion groove 21*a* and can allow to pull the same.

Figure 11:
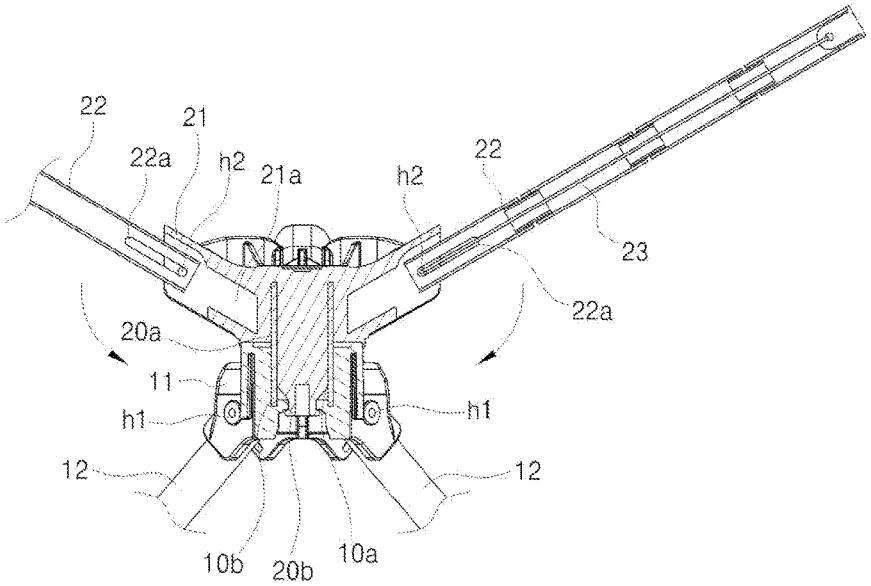
FIG. 11 is a side cross sectional view illustrating an engaged state of an upper block and a support part according to another embodiment of the present invention.
Figure 12:
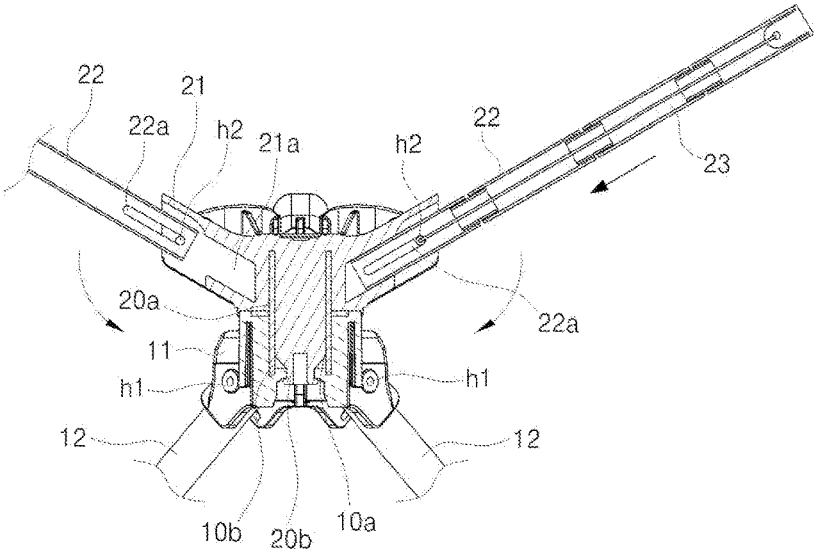
FIG. 12 is a side cross sectional view illustrating a state where an upper block and a support part are engaged according to another embodiment of the present invention.

In addition, as illustrated in FIGS. 11 and 12, another embodiment of the present invention may be implemented in such a way to provide the elastic member 23 one end of which is fixed at the second hinge pin (h2), and the other end of which is fixed at an end of the other side of the support part 22, wherein the elastic member 23 is able to provide an elastic force for the support part 22 arranged at a second angle to be inserted in the insertion groove 21*a*.

As illustrated in FIGS. 11 and 12, the present invention is configured in such a way that the end of the other side of the support part 22 can move in the direction of the insertion groove 21*a* with the aid of the elastic force of the elastic member 23, by which the end of one side of the support part 22 can slide and be engaged in the insertion groove 21*a*.

As illustrated in FIGS. 11 and 12, a plurality of the support parts 20 can be engaged detachable through an insert tube which is inserted inside, and the engagement thereof can be strongly maintained with the aid of the configuration of the elastic member 23. A stopper may be provided at an end of the other side of the support part 22, wherein the elastic member 23 an end of which is fixed at the second hinge pin (h2), can be connected to the stopper.

Figure 13:
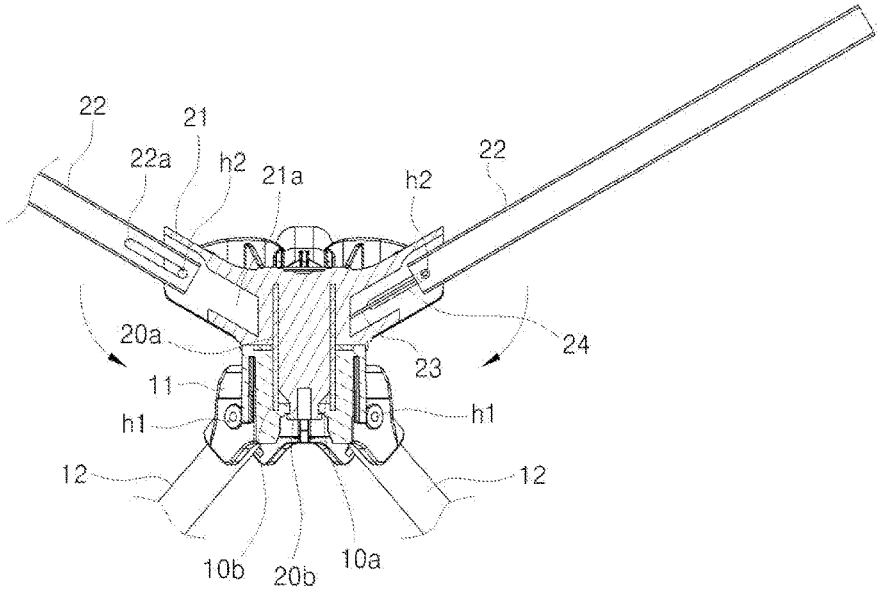
FIG. 13 is a side cross sectional view illustrating a state where an upper block and a support part are engaged according to another specific example of the present invention.
Figure 14:
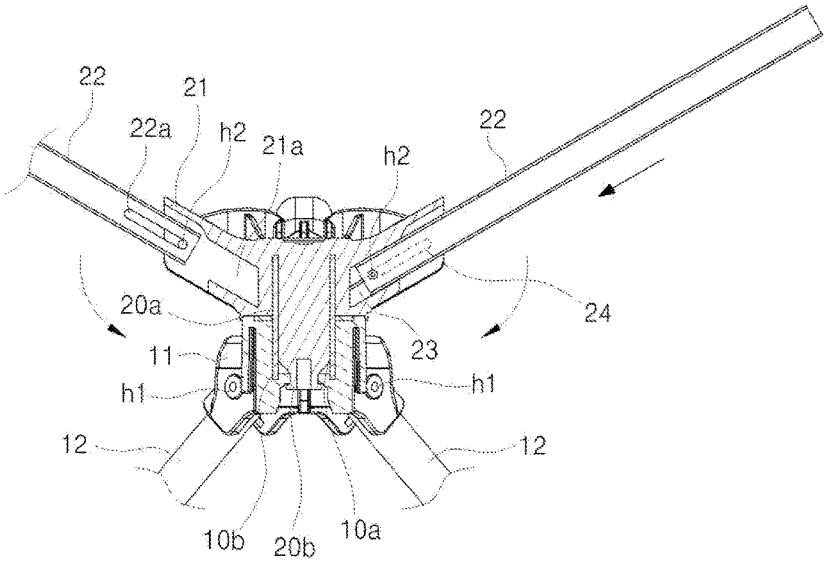
FIG. 14 is a side cross sectional view illustrating a state where an upper block and a support part are engaged according to further another specific example of the present invention.

Meanwhile, according to another specific example of the present invention, as illustrated in FIGS. 13 and 14, the second stopper part 21 may include a guide hole 24 having a predetermined length in the longitudinal direction, and the portion covering the tops of the support parts 22 extends and projects outward from the center of the upper block 20 while defining the second angle, and the second hinge pin (h2) is slide-engaged in the guide hole 24, thus being installed at the support part 22. The support part 22 is disposed for the other end of which to be rotatable within a range of the second angle from the lower center direction when the end of one side of the guide hole 24 is hung over the second hinge pin (h2), and in the state of the second angle, it can slide in the direction of the center of the upper block 20 as it is guided by the second stopper part 21 and the second hinge pin (h2). The rotations of the other end thereof can be prevented in a state where it has slid for the second hinge pin (h2) to position at a portion out of the end of one side of the guide hole 24.

At this time, since the configuration of the lower block 10 and the upper block 20 is same as the configuration of the specific examples of the present invention in their configuration and functions, the detailed descriptions thereof will be omitted.

The upper block 20 according to another specific example of the present invention, however, may further include an insertion groove 21*a* into which an end of one side of the support part 22 is inserted at a second angle in response to the sliding of the support part 22, and an elastic member 23 an end of which is fixed at an end of the depth direction of the insertion groove 21*a*, and the other end of which is fixed at the second hinge pin (h2), wherein the elastic member 23 can provide an elastic force for the support part 22 arranged at a second angle to be inserted in the insertion groove 21*a*.

As illustrated in FIGS. 13 and 14, the aforementioned configuration is provided so as to facilitate the engagement and disengagement of the second stopper part 21 and the support part 22. The support parts 22 engaged via the second hinge pin (h2) to the second stopper part 21 can be easily folded or unfolded with the aid of the engaged configuration of the second hinge pin (h2) and the guide hole 24.

Moreover, an insertion groove 21*a* into which an end portion of one side of the support part 22 is inserted at a second angle in response to the sliding of the support parts 22, may be further formed at the upper block 20, by which as illustrated in FIG. 14, if the support parts 22 are slide-engaged in the insertion groove 21*a*, the stopper part 21 and the support parts 22 can be strongly engaged, so the fixed state of the support parts 22 can be maintained stable.

In addition, there may be further provided an elastic member 23 an end of which is fixed at an end in the depth direction of the insertion groove 21*a*, and the other end of which is fixed at the second hinge pin (h2), wherein the elastic member 23 is able to provide an elastic force allowing the support part 22 to be inserted in the insertion groove 21*a*. As illustrated in FIGS. 13 and 14, an easier and strong engagement can be secured, wherein the support parts 2 are pulled and engaged in the direction of the insertion groove 21*a*.

Figure 10:
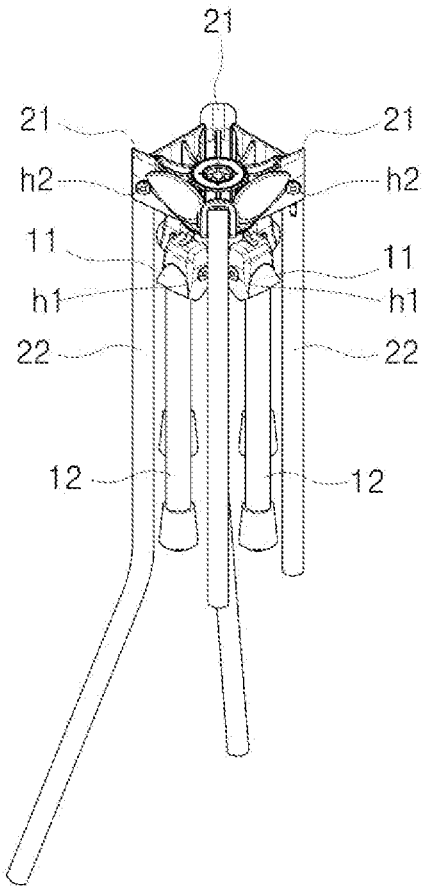
FIG. 10 is a perspective view illustrating a state where a folding chair is folded according to the present invention.

Furthermore, as illustrated in FIG. 10, there may be further provided a seating part 13 which allows the support part 22 to contact close with each other if the legs 12 and the support parts 22 are folded in the same direction.

As illustrated in FIG. 10, if the legs 12 and the support parts 22 are folded in the same direction, the support parts 22 are disposed close to the seating part 13 of the lower block 10, and the legs 12 are moved close to the inside, by which the folding chair can be easily folded.

The configuration of the seating part 13 allows for a convenient carriage and storage in such a way to minimize the volume of the folding chair after the folding chair of the present invention has been folded as illustrated in FIG. 10.

Figure 2:
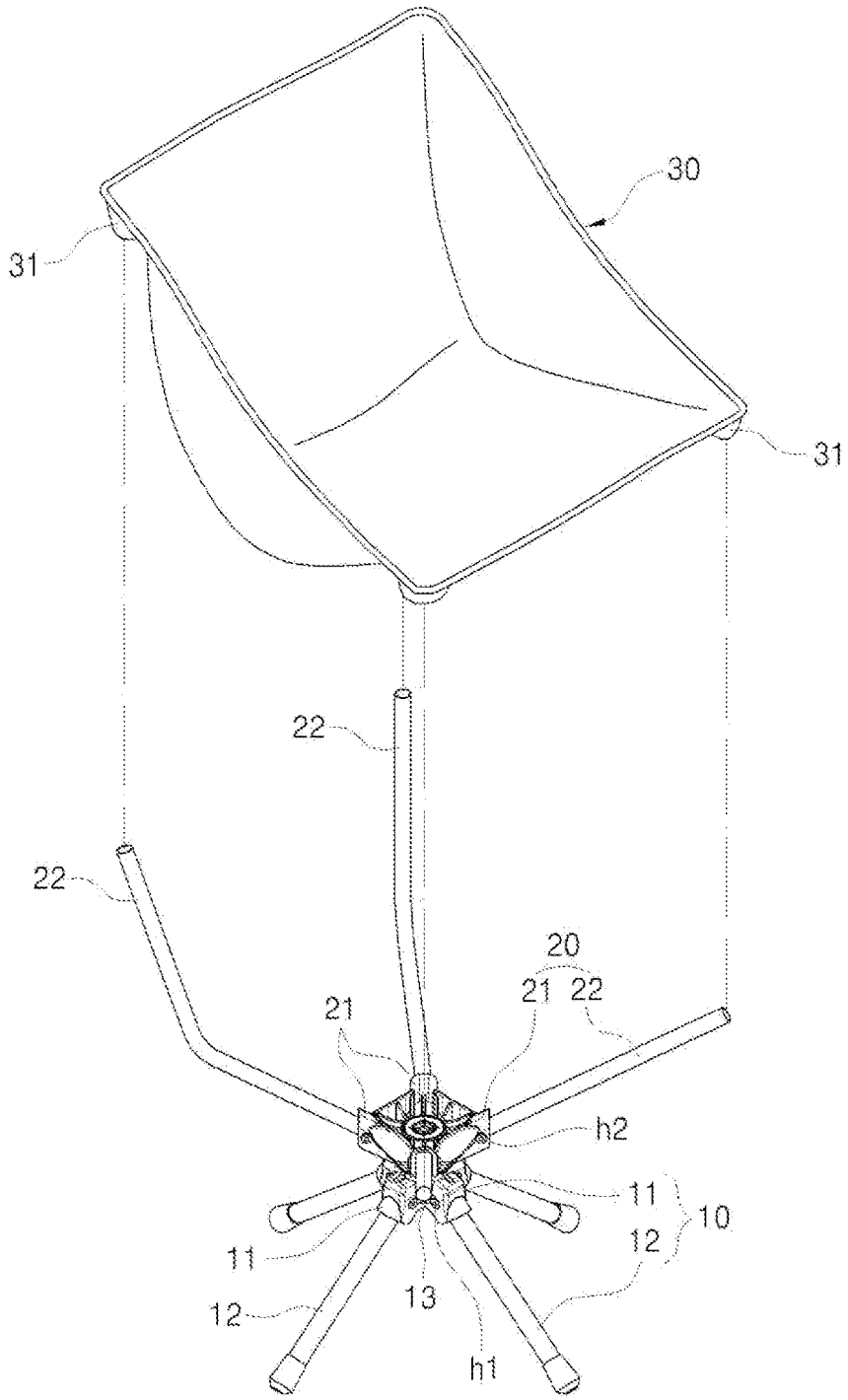
FIG. 2 is a perspective view illustrating a folding chair according to the present invention.

For the sake of an easier engagement of the support parts 22, the seating member 30 of the present invention, as illustrated in FIG. 2, may further include a plurality of pockets 31 to which the support parts 23 are connected. It is obvious that the pockets 31 can be adapted based on the user's selection.

Figure 15:
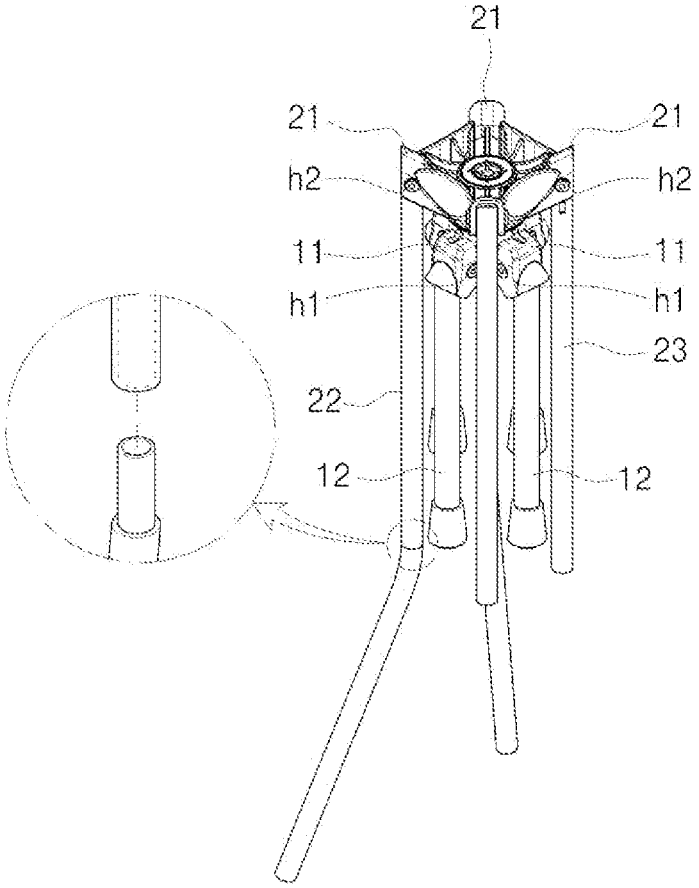
FIG. 15 is a side cross sectional view illustrating a support part of a folding chair according to another embodiment of the present invention.

As illustrated in FIG. 15, the support parts 22 of the present invention may be configured in such a way that the intermediate part thereof can be separable, by which if the support parts 22 are folded, the space occupied by the support parts 22 can be reduced.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

(Legend of Reference number)

| | |
|---|---|
| 10: Lower block | 10a: Through hole |
| 10b: Support tubular body | 11: First stopper part |
| 12: Leg | 20: Upper block |
| 20a: Engaging groove | 20b: Rotary shaft |
| 21: Second stopper part | 21a: Insertion groove |
| 22: Support part | 22a: Longitudinal hole |
| 23: Elastic member | 24: Guide hole |
| 30: Seating member | 31: Pockets |
| h1: First hinge pin | h2: Second hinge pin |

The invention claimed is:

1. A folding chair, comprising:

a lower block equipped with each of a plurality of first stopper parts which is connected via a first hinge pin with an end of each of a plurality of legs along a circumference thereof, wherein the first stopper part is configured to limit the other end of each of the legs to rotate in a lower central direction and between first angles which have been previously set;

an upper block equipped with each of a plurality of second stopper parts which is configured to horizontally rotate based on an axial connection to the lower block and is connected via a second hinge pin to an end of each of a plurality of support parts along a circumference thereof, wherein the second stopper part is configured to limit the other end of each of the support parts to rotate in the lower central direction and between second angles which have been previously set; and a seat member which is installed connecting the other end of each of the support parts which receive supports of upper side rotation angles from the second stopper part, wherein the legs and the support parts are configured to be folded or unfolded in the same directions, wherein the lower block includes a through hole, and a support tubular body having a lower end which is inserted in the through hole, and the upper block includes an engaging groove into which an upper end of the support tubular body is inserted, and a rotary shaft which is inserted in the support tubular body.

2. The folding chair of claim 1, wherein the second stopper part is configured in such a way that a portion covering a top of an end of the support part extends and protrudes outward from the center of the upper block while forming the second angle, and the second hinge pin is installed at a side portion of an outer side of the second stopper parts, and the support part is configured in such a way that a longitudinal hole having a predetermined length in a longitudinal direction of the support part while passing through the second hinge pin is formed at a side portion of one side thereof, and the support part is configured in such a way that the other end thereof is rotatable within a second angle range from the lower central direction when an end of one side of the longitudinal hole is hung over the second hinge pin, and a sliding occurs in the central direction of the upper block by receiving guides from the second stopper part and the second hinge pin in a second angle state, and the rotation of the other end thereof is prevented in a state where the second hinge pin has slid to position at a portion which is out of an end of one side of the longitudinal hole.

3. The folding chair of claim 2, wherein the upper block includes an insertion groove into which an end of one side of the support part is inserted at a second angle in response to the sliding of the support part.

4. The folding chair of claim 3, further comprising an elastic member an end of which is fixed at the second hinge pin, and the other end of which is fixed at the other end of the support part, wherein the elastic member is configured to provide an elastic force for the support part arranged at a second angle to be inserted into the insertion groove.

5. The folding chair of claim 3, further comprising an elastic member an end of which is fixed at an end in a depth direction of the insertion groove, and the other end of which is fixed at an end of the support part, wherein the elastic member is configured to provide an elastic force for the support part arranged at a second angle to be inserted in the insertion groove.

6. The folding chair of claim 1, wherein the second stopper part includes a guide hole having a predetermined length in a longitudinal direction, and a portion configured to cover a top of the support part extends and protrudes outward from the center of the upper block at the second angle, and the second hinge pin is installed at the support part in such a way to be slide-engaged to the guide hole, and the support part is configured in such a way that when an end of one side of the guide hole is hung over the second hinge pin, the other end thereof is rotatable within a range of the second angle from the lower central direction, and a sliding is available in the central direction of the upper block by receiving guides from the second stopper part and the second hinge pin in a state of the second angle, and the rotation of the other end thereof can be prevented in a slid state for the second hinge pin to position out of an end of one side of the guide hole.

7. The folding chair of claim 6, wherein the upper block further comprises an insertion groove into which an end portion of one side of the support part is inserted at a second angle in response to the sliding of the support part.

8. The folding chair of claim 7, further comprising an elastic member an end of which is fixed at an end in a depth direction of the insertion groove, and the other end of which is fixed at the second hinge pin, wherein the elastic member is configured to provide an elastic force for the support part arranged at a second angle to be inserted in the insertion groove.

* * * * *